US005224300A

United States Patent [19]

Pineau

[11] Patent Number: 5,224,300

[45] Date of Patent: Jul. 6, 1993

[54] MACHINE FOR THE ABRASIVE MACHINING OF CYLINDRICAL PARTS

[75] Inventor: Eric Pineau, Niederlenz, Switzerland

[73] Assignee: Mecaloir Technologies, Chateaudun, France

[21] Appl. No.: 819,343

[22] Filed: Jan. 9, 1992

[30] Foreign Application Priority Data

Jan. 11, 1991 [FR] France ..... 91 00296

[51] Int. Cl.[5] ..... B24B 21/12

[52] U.S. Cl. ..... 51/66; 51/62; 51/139; 51/142; 51/103 TF; 51/289 R

[58] Field of Search ..... 51/49, 50 H, 79, 39, 51/103 TF, 139, 289 R, 62, 66, 142, 141, 65, DIG. 5

[56] References Cited

U.S. PATENT DOCUMENTS

| | | | |
|---|---|---|---|
| 413,786 | 10/1889 | Miller | 51/DIG. 5 |
| 2,119,862 | 6/1938 | Keller | 51/142 |
| 2,258,733 | 10/1941 | Brackett | 51/62 |
| 2,756,547 | 7/1956 | Rippl | 51/142 |
| 3,040,483 | 6/1962 | Sloan | 51/62 |
| 3,041,792 | 7/1962 | La Fleur | 51/154 |
| 4,796,387 | 1/1989 | Johnson | 51/62 |
| 5,060,423 | 10/1991 | Klotz | 51/289 R |

FOREIGN PATENT DOCUMENTS

| | | |
|---|---|---|
| 2003866 | 11/1969 | France . |
| 2331068 | 1/1975 | France . |
| 656686 | 8/1951 | United Kingdom . |

*Primary Examiner*—Robert A. Rose

*Attorney, Agent, or Firm*—Brumbaugh, Graves, Donohue & Raymond

[57] ABSTRACT

Machine for the abrasive machining of cylindrical parts, on which the parts to be machined are driven in rotation and in axial translational motion by supporting and driving means. The machine comprises a plurality of bands (17) of abrasive cloth having grains of increasing fineness in the direction of axial translational motion (A) of the parts to be machined, advancing means for unwinding each band (17) from a reel of new cloth continuously during the machining and for rewinding it onto a reel of worn cloth, bearing means for applying each band (17) with a predetermined pressure onto the parts to be machined, and oscillation means (18, 19, 20) for driving the said bearing means in an oscillating movement in axial translational motion.

The invention is used, for example, for the superfinishing of shock-absorber rods, of cylindrical rollers, etc.

6 Claims, 3 Drawing Sheets

MACHINE FOR THE ABRASIVE MACHINING OF CYLINDRICAL PARTS

The present invention relates to a machine for the abrasive machining of cylindrical parts, comprising means for supporting the parts and for driving them in rotation about their axes and in axial translational motion, and machining means comprising a plurality of stations for abrasive machining with grains of increasing fineness, succeeding one another in the direction of axial translational motion of the parts and acting successively on the parts during the axial translational motion of these.

A known machine of this type, used for the superfinish machining of cylindrical parts, such as shock-absorber rods, cylindrical rollers, etc., comprises, as a device for supporting the parts and for driving them in rotation and in axial translational motion, two rollers cooperating with the parts to be machined in the manner of centreless grinding wheels in a row. The machining means consist of a succession of abrasive stones whose applied pressures on the part to be machined are continuously adjustable and different according to the quality of the stones used. Each of these stones is supported by a pneumatic or hydraulic jack, and the jacks, (of which there are usually six, eight or ten), arranged in succession in the direction of the axial translational motion which the parts execute under the effect of the supporting and driving rollers, carry stones of finer and finer grains, thus making it possible to bring a part to the desired superfinished state in one pass.

This machining technique has proved successful, but requires an adaptation of the quality of the stones to the part to be machined in terms of both the hardness and the material of the part to be machined. It is therefore necessary, for each type of part to be machined, to select a set of machining stones of grains of different finenesses, these stones being adapted to the operation to be carried out. Moreover, the method of production of these abrasive stones does not always make it possible to obtain perfect homogeneity, particularly where so-called sulphured stones are concerned, a lack of homogeneity being capable of causing a "calking", that is to say a clogging of the stones, resulting in defective machining. Moreover, the number of successive stones necessary to bring a part from a specific initial state to a specific superfinished state is relatively large.

The object of the present invention is to provide a machine for abrasive machining which, whilst being of simple structure and reliable operation, eliminates the risks and imponderables of the known machines for machining with abrasive stones, thus ensuring a more uniform machining at a reduced cost.

On the machine according to the invention for the abrasive machining of cylindrical parts, on which the parts to be machined are driven in rotation and in axial translational motion by supporting and driving means, the machining means comprise a plurality of bands of abrasive cloth having grains of increasing fineness in the direction of axial translational motion of the parts. The machining means comprise, furthermore, advancing means for unwinding each band of abrasive cloth from a reel of new cloth continuously during the machining and for rewinding it onto a reel of worn cloth. The machining means comprise, moreover, bearing means for applying each band of abrasive cloth with a predetermined pressure onto the parts to be machined. Finally, the machining means comprise oscillation means for driving the said bearing means in an oscillating movement in axial translational motion.

The replacement of the abrasive stones of the known machining machines by bands of abrasive cloth experiencing a continuous advancing movement makes it possible, for an equal or even better machining quality, to reduce considerably the number of machining stations necessary for bringing parts from the same initial state to an equal or even better superfinished state. Moreover, the machine according to the invention ensures this final state with clearly increased reliability, because the continuously advancing bands of abrasive cloth used on the machine according to the invention eliminate the disadvantages associated with the abrasive stones used on known machines.

Preferably, the means for supporting the parts to be machined and for driving them in rotation and in axial translational motion comprise two rollers cooperating with the parts to be machined by means of the so-called "centreless effect".

The means for the bearing of the bands of abrasive cloth on the parts to be machined preferably comprise a plurality of bearing rollers carried by a plurality of jacks fastened to a stage movable in axial translational motion under the action of oscillation control means.

Thus, only the jacks and the bearing rollers carried by these jacks are driven in an oscillating movement which, as is well known, is necessary to give the parts the requisite surface state, whereas the reels of new cloth and the reels of worn cloth as well as the means for advancing the bands of abrasive cloth are stationary. Nevertheless, the bands of abrasive cloth, in their part located between the reels of new cloth and the reels of worn cloth, can easily follow the oscillating movements of reduced amplitude of the bearing rollers.

Preferably, the means for advancing the bands of abrasive cloth comprise a system for the common driving of all the reels of worn cloth of the machine.

These advancing means can preferably comprise a geared motor driving a shaft, from which all the reels of worn cloth are driven by means of belt transmissions.

To simplify the replacement of the reels of new cloth and reels of worn cloth, it is advantageous if each abrasive-machining station comprises two spindles with an inflatable elastic diaphragm, for the purpose of the pneumatic flanging and unflanging of the reel of new abrasive cloth and of the reel of worn abrasive cloth on the two spindles.

Referring to the accompanying diagrammatic drawings, a non-limiting illustrative embodiment of a machine according to the invention will be described in more detail hereafter; in the drawings.

Figure 1:
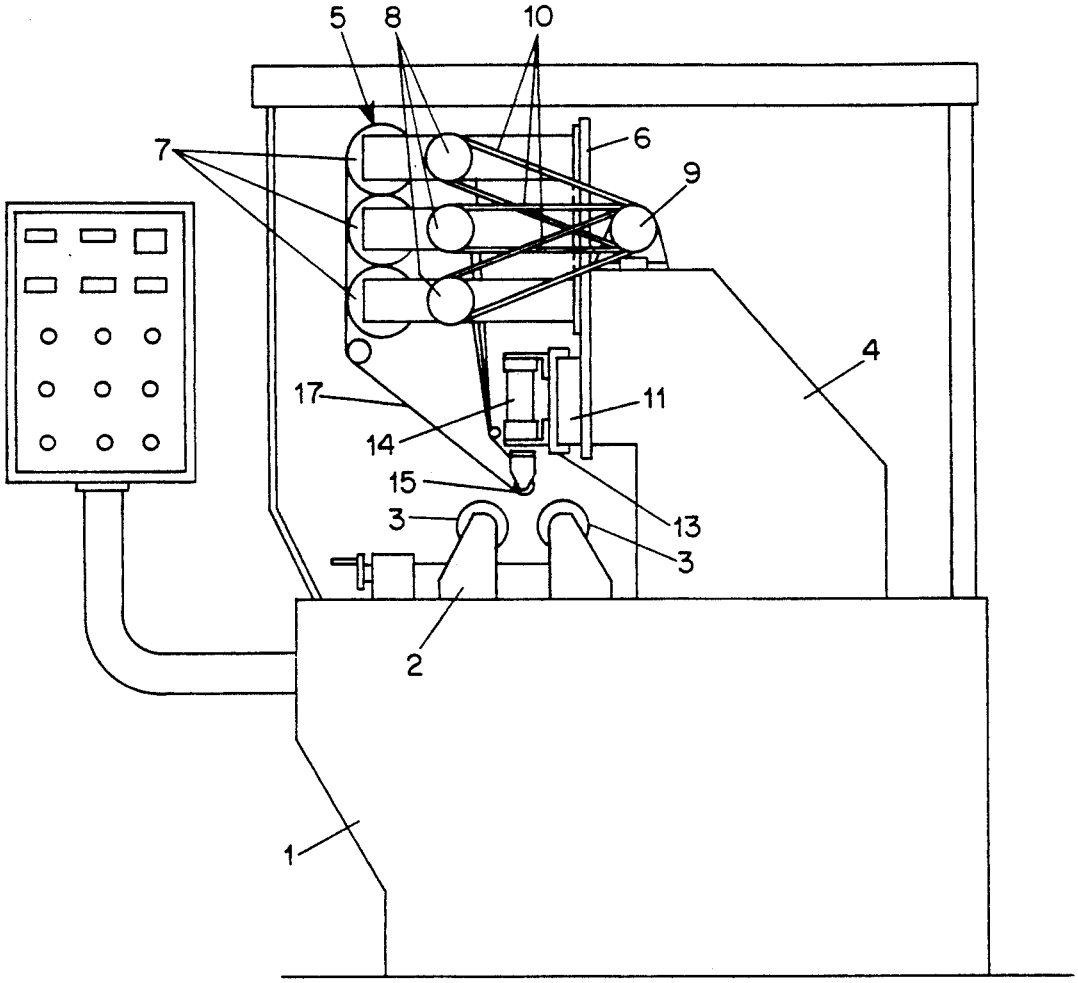
FIG. 1 is a side view and FIG. 2 a front view of a machining machine according to the invention with three machining stations.
Figure 2:
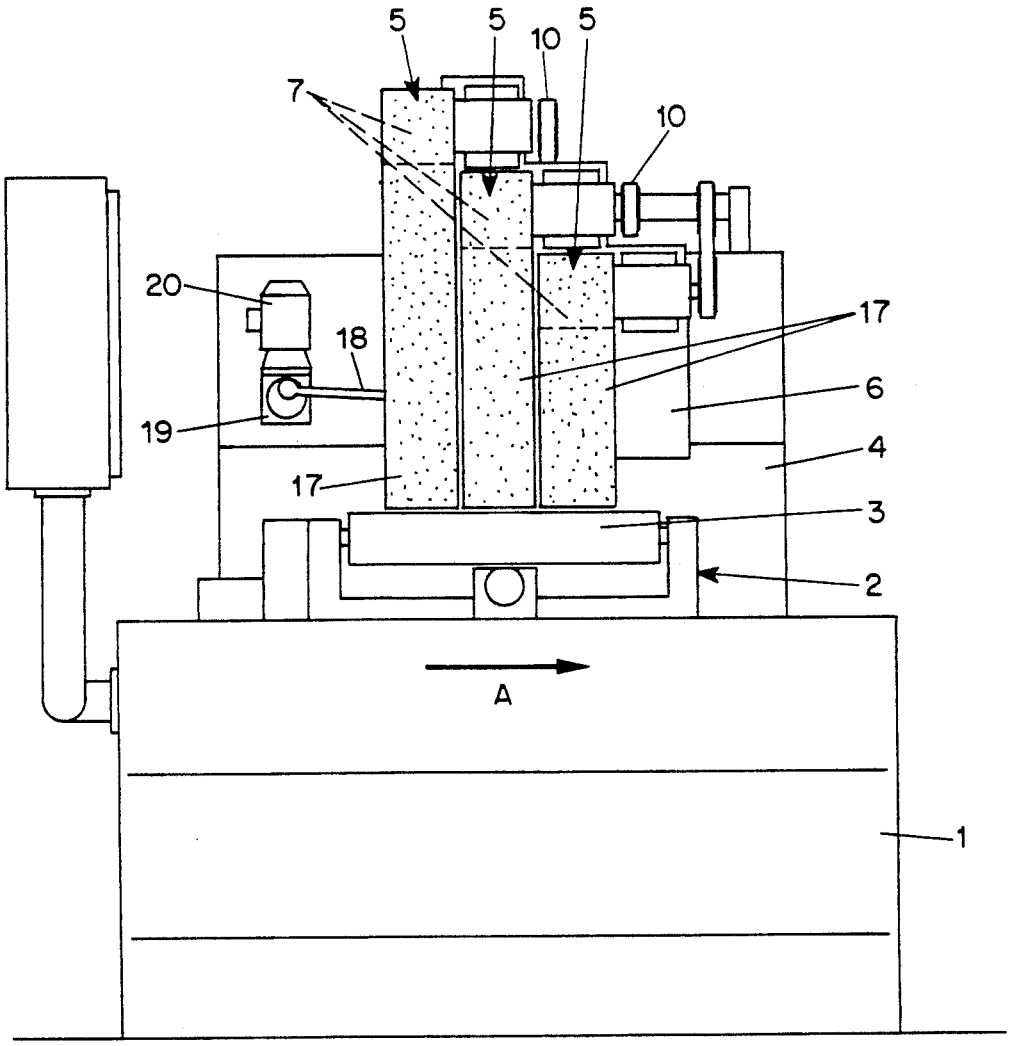

As illustrated in FIGS. 1 and 2, a machine according to the invention for the abrasive machining of cylindrical parts, for example the superfinishing of shock-absorber rods or of cylindrical rollers, comprises, on a stationary stand 1, an assembly 2 for supporting the parts to be machined (not shown) and for driving them in rotation and in axial translational motion. The assembly 2 comprises, in a way known per se, two cylindrical rollers 3 arranged side by side and driven in rotation in such a way that the parts to be machined, brought one behind the other on the two rollers at one end of these, are simultaneously driven in rotation about their axes and driven in axial translational motion by the two rollers 3 as a result of a so-called "centreless" effect, as is well known, for example, for centreless grinders in a row.

The spacing of the two rollers 3 is adjustable for the purpose of adapting the supporting assembly 2 to parts to be machined of different diameters.

The stand 1 carries, furthermore, a bracket 4, on which are mounted a plurality of abrasive-machining units 5 arranged one behind the other in the direction of axial translational motion of the parts to be machined on the supporting assembly 2 (arrow A in FIG. 2).

A stage 6 fixed to the bracket 4 carries, for each machining unit 5, a reserve reel 7 of new abrasive cloth and a rewinding reel 8 of worn abrasive cloth. The rewinding reels 8 are driven by a geared motor 9 installed on the column 4 by means of a belt transmission 10.

Figure 3:
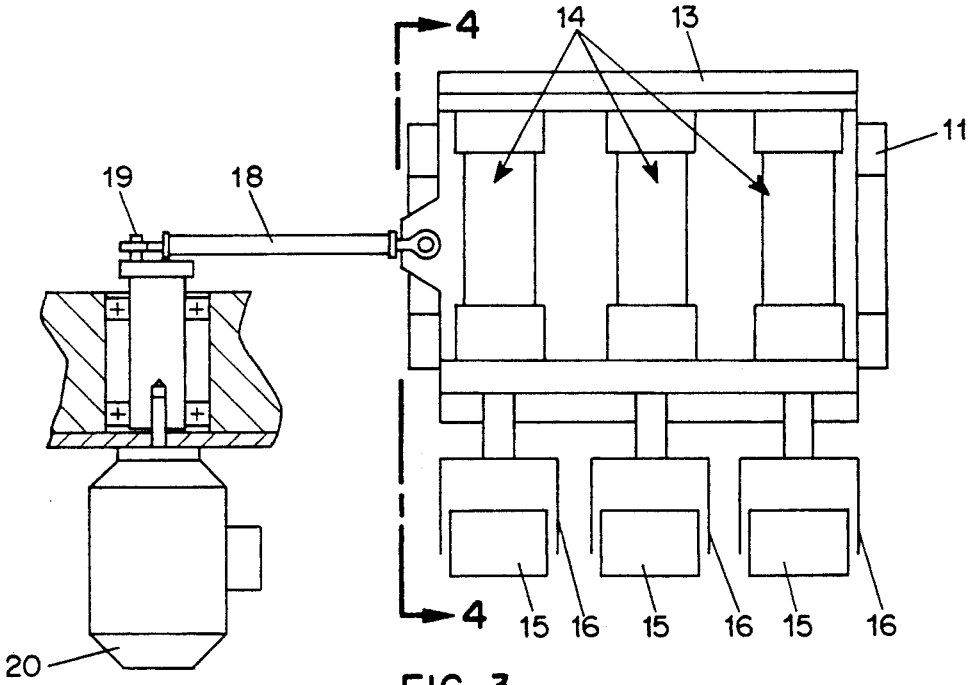
FIG. 3 is a front view of the movable stage carrying the bearing-roller control jacks and the oscillation control of this stage.
Figure 4:
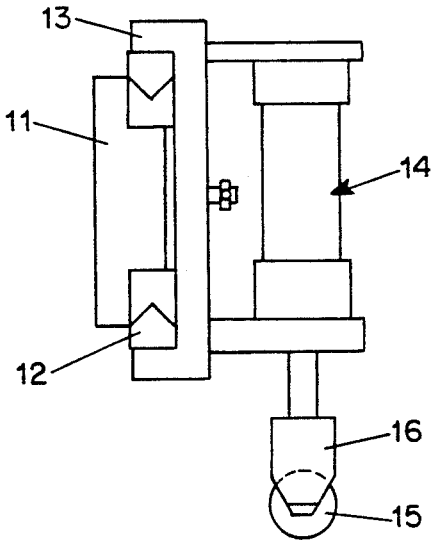
FIG. 4 is a section according to IV—IV of FIG. 3.

The column 4 carries, moreover, a stage 11, on which a stage 13 carrying a plurality of jacks 14 is mounted movably in horizontal translational motion by means of slideways 12. Each jack 14 carries, at the lower end of its piston rod, a bearing roller 15 mounted in rotation on a yoke 16 (see FIGS. 3 and 4).

As emerges particularly from FIGS. 1 and 2, a band of abrasive cloth 17 goes from each reserve reel 7 to the corresponding rewinding reel 8, at the same time passing over a bearing roller 15.

The stage 13 is coupled by means of a connecting rod 18 to an eccentric 19 driven by a motor 20.

Figure 5:
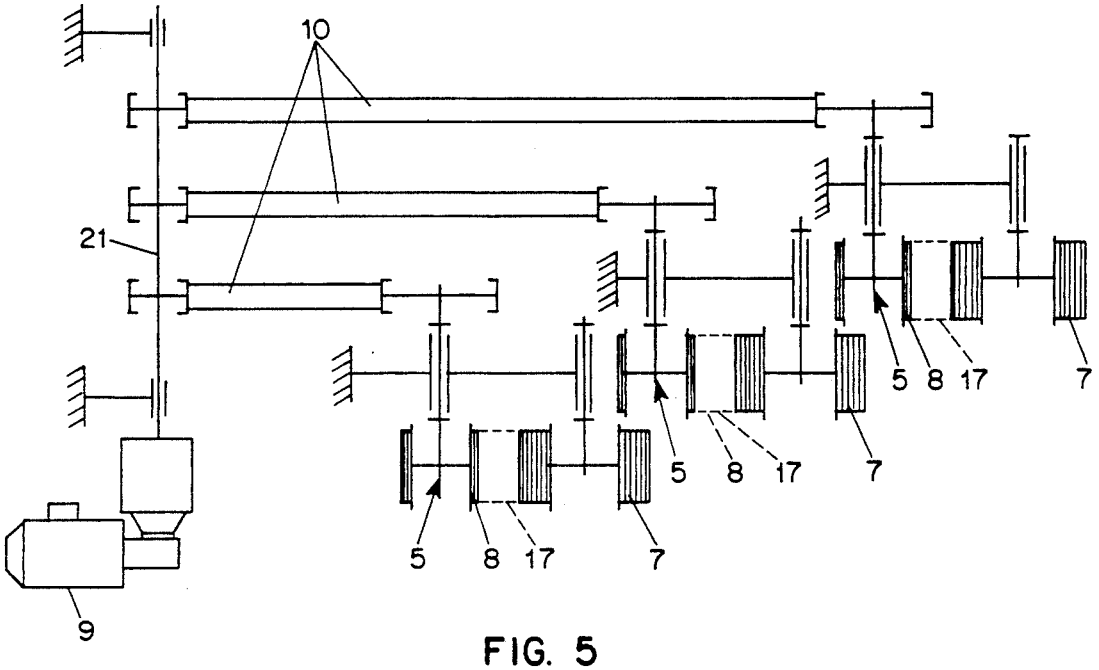
FIG. 5 is a diagrammatic view of the cinematics of the system for the continuous advance of the bands of abrasive cloth.
Figure 6:
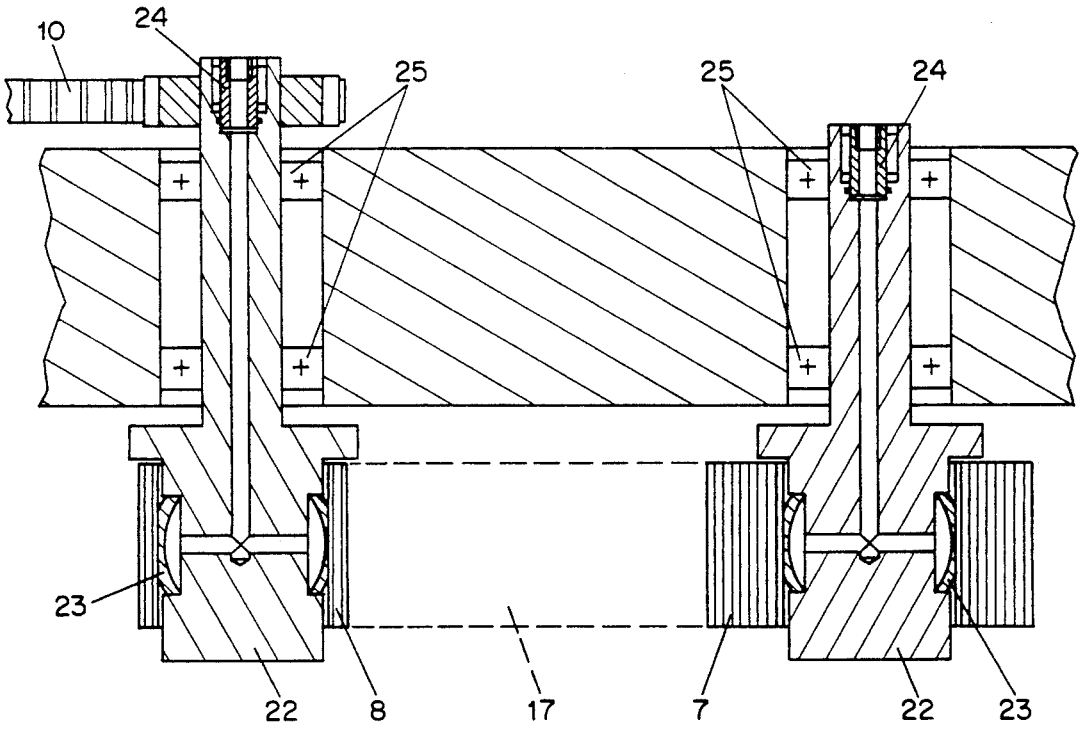
FIG. 6 shows the inflatable-diaphragm spindles for the flanging of the reel of new cloth and the reel of worn cloth of a machining station.

The diagram of FIG. 5 shows that all the belt transmissions 10 driving the abrasive-cloth rewinding reels 8 for the purpose of the continuous advance of the cloths 17 drawn off from the reserve reels 7 are controlled by the gear motor 9 by means of a common shaft 21.

According to the Figure, each rewinding reel 8 driven by a belt transmission 10 and each reserve reel 7 is mounted on a spindle 22 carrying an elastic diaphragm 23 inflatable by means of compressed air arriving by way of a revolving joint 24 at the spindle 22 mounted in rotation by means of bearings 25.

When a part brought, for example, by a conveyor arrives on the rollers 3 at the left end in FIG. 2, the jack 14 of the first machining unit 5 is controlled in such a way that the abrasive cloth of this first unit is applied by the pressure roller 15 of this jack 14 against the part to be machined. As a result of the so-called centreless effect, the part to be machined is driven in rotation about its axis and in axial translational motion, thus causing it to come successively into contact with the abrasive cloths of the other machining units 5. Because the bands of abrasive cloth of increasing fineness of the successive machining units 5 are driven continuously during the machining, the successive parts are all subjected to identical machining conditions, as a result of which parts of uniform quality are obtained.

Of course, the embodiment described above and illustrated by the accompanying drawings has been given only as a non-limiting indicative example and many modifications and alternative versions are possible within the scope of the invention. Thus, the number of successive machining units on the same machine can differ from three, this number can be increased according to the quality demanded for the machined parts.

Furthermore, for changing the reserve reels and the rewinding reels, it is possible to employ means other than spindles with an inflatable diaphragm.

I claim:

1. A machine for the abrasive machining of a cylindrical part; comprising in combination:

support-and-driving means for supporting and driving the cylindrical part in rotation about its axis and in axial translational motion; and machining means, comprising a plurality of machining stations for abrasive machining of the cylindrical part with grains of increasing fineness succeeding one another in the direction of axial translational motion of the cylindrical part and acting successively on the cylindrical part during axial translational motion of the cylindrical part, comprising:

a plurality of supply reels, each for a band of abrasive cloth having grains of increasing fineness in the direction of axial translational motion of the cylindrical part, a plurality of take-up reels, each for rewinding a worn abrasive cloth, advancing means for continually unwinding each band of abrasive cloth from its supply reel during machining and for rewinding it onto a take-up reel, bearing means for applying each band of abrasive cloth with a predetermined pressure onto the cylindrical part during machining, and oscillation means for driving the bearing means in an oscillating movement in axial translational motion;

said bearing means comprising:

a movable stage, movable in axial translational motion, oscillation control means adapted to act on the movable stage, a plurality of jacks fastened to the movable stage, and a plurality of bearing rollers carried by the jacks.

2. The machine according to claim 1, wherein the supply reels, the take-up reels, and the advancing means are stationary.

3. The machine according to claim 1, wherein the support-and-drive means comprises two rollers adapted to cooperate with the cylindrical part as a result of a centreless effect.

4. The machine according to claim 1, 2 or 3, wherein the advancing means comprises a system for the common driving of the take-up reels.

5. The machine according to claim 4, wherein the advancing means comprises:

a shaft;

a geared motor coupled to the shaft; and a belt transmission coupled to the shaft for driving the take-up reels.

6. The machine according to claim 1, 2 or 3, wherein each machining station comprises two spindles with an inflatable elastic diaphragm for pneumatic flanging and unflanging of the reels.

* * * * *